United States Patent [19]

Suzuki et al.

[11] Patent Number: 4,640,022

[45] Date of Patent: Feb. 3, 1987

[54] CLOTHES DRYER

[75] Inventors: Masami Suzuki, Shiga; Tatsuya Hirota, Kyoto; Masahiko Maeda, Shiga, all of Japan

[73] Assignee: Sanyo Electric Co., Ltd., Japan

[21] Appl. No.: 702,834

[22] Filed: Feb. 19, 1985

[30] Foreign Application Priority Data

Feb. 20, 1984 [JP] Japan ..... 59-30737

[51] Int. Cl.[4] ..... F26B 25/22

[52] U.S. Cl. ..... 34/48; 34/53; 34/55

[58] Field of Search ..... 34/53, 48, 55

[56] References Cited

U.S. PATENT DOCUMENTS

| | | | |
|---|---|---|---|
| 3,218,730 | 11/1965 | Menk et al. | 34/48 |
| 3,302,299 | 2/1967 | Scherzinger | 34/53 |
| 3,394,465 | 7/1968 | Janke | 34/53 |
| 4,112,589 | 9/1978 | Palfrey et al. | 34/48 |
| 4,209,915 | 7/1980 | Keuleman et al. | 34/48 |
| 4,231,166 | 11/1980 | McMillan | 34/48 |
| 4,267,643 | 5/1981 | Haried | 34/48 |
| 4,286,391 | 9/1981 | Gerry | 34/55 |
| 4,397,101 | 8/1983 | Richard | 34/53 |
| 4,485,566 | 12/1984 | Vivares | 34/55 |

FOREIGN PATENT DOCUMENTS 58-173599 12/1983 Japan .

*Primary Examiner*—Albert J. Makay
*Assistant Examiner*—David W. Westphal
*Attorney, Agent, or Firm*—Darby & Darby

[57] ABSTRACT

A clothes dryer of the dehumidifying type in which exhaust air from a drying space containing a load being dried is subjected to heat exchange with external air for removing moisture from the exhaust and, after being re-heated by a heater, the exhaust air is returned to the drying space again by a fan so as to dry the load with heated air. The clothes dryer includes a first heat-sensitive device for measuring the temperature of exhaust air at an outlet of the drying space, and a second heat-sensitive device for measuring the temperature of the exhaust air after having been subjected to the heat exchange with external air or the temperature of the external air after having been subjected to the heat exchange with the exhaust air. The difference between the temperatures measured by the first and second heat-sensitive device at a predetermined time after the starting of the drying operation is stored in a memory as a reference value A, and the later relation between the measured temperature difference and the reference value A, is checked to control the termination of the heat drying operation.

9 Claims, 22 Drawing Figures

FIG. 7B-I
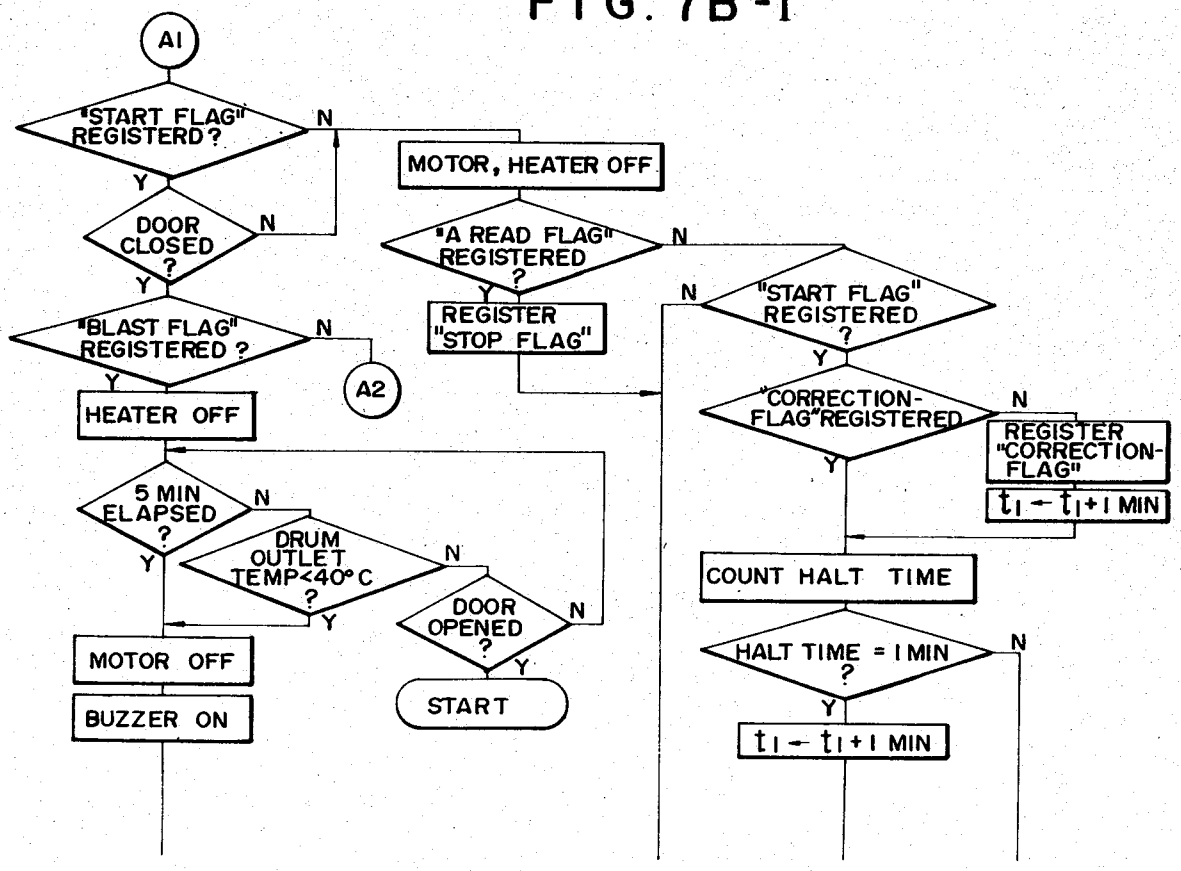

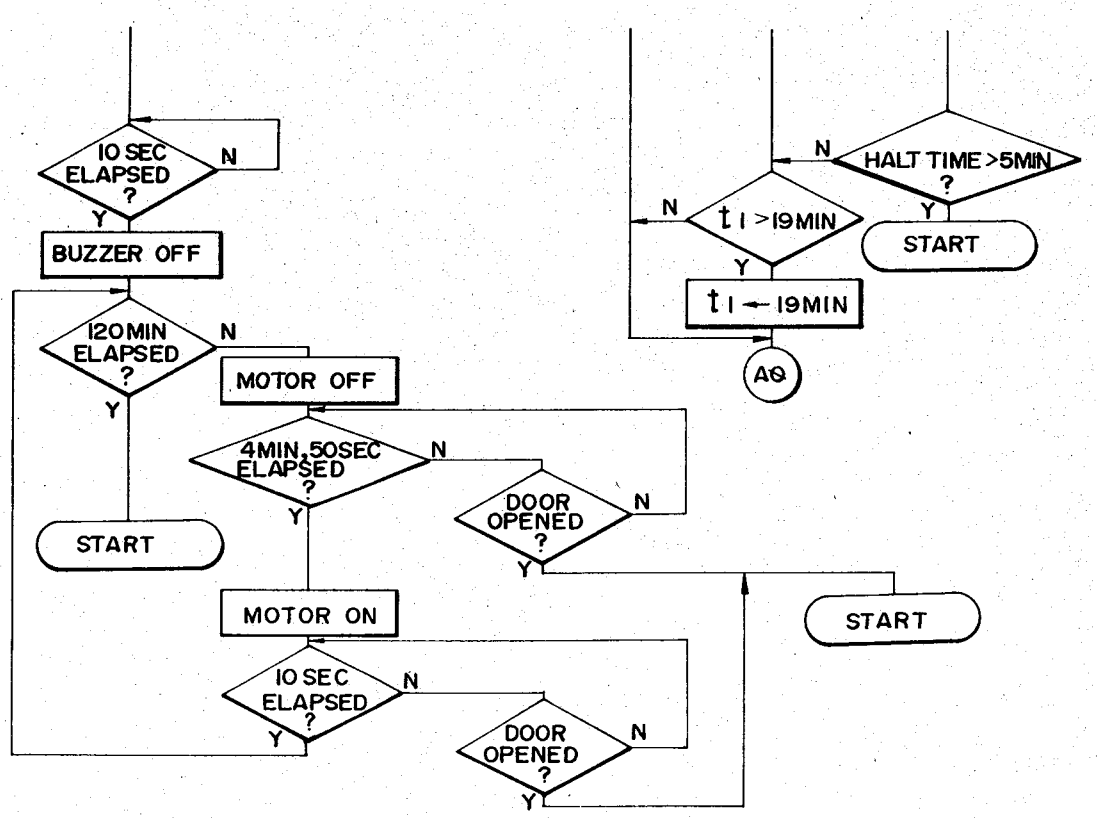
FIG. 7B-II

FIG. 7E-I
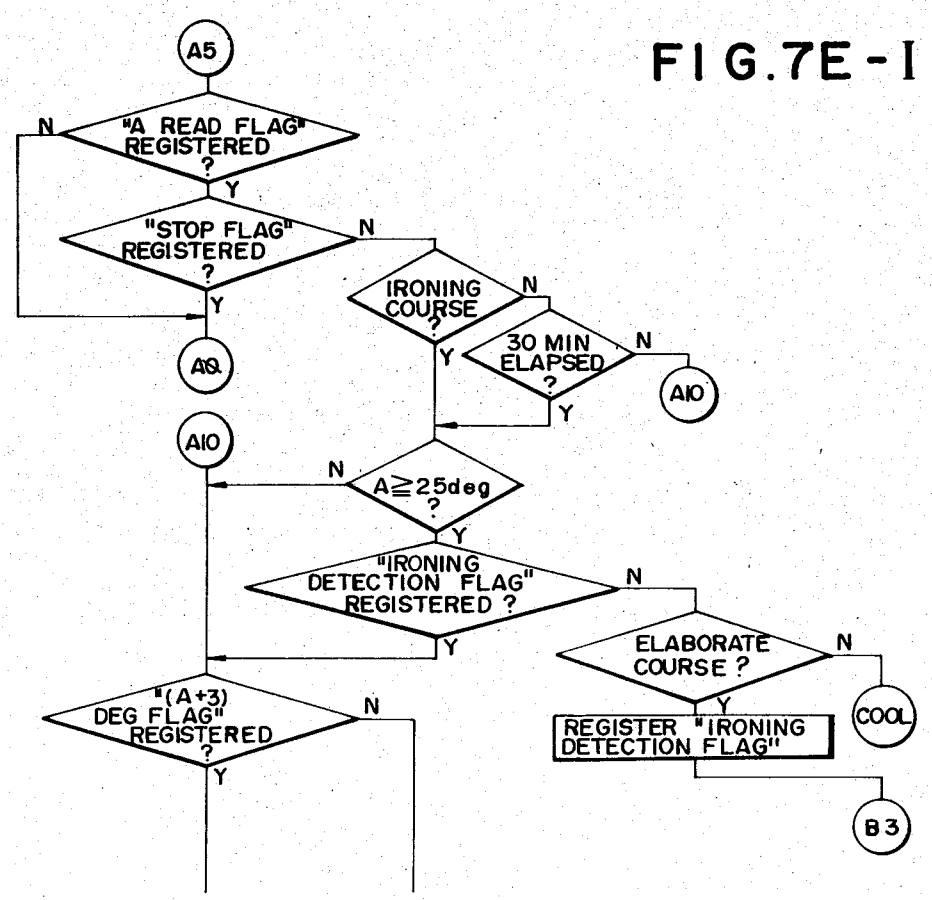

FIG. 7E-II
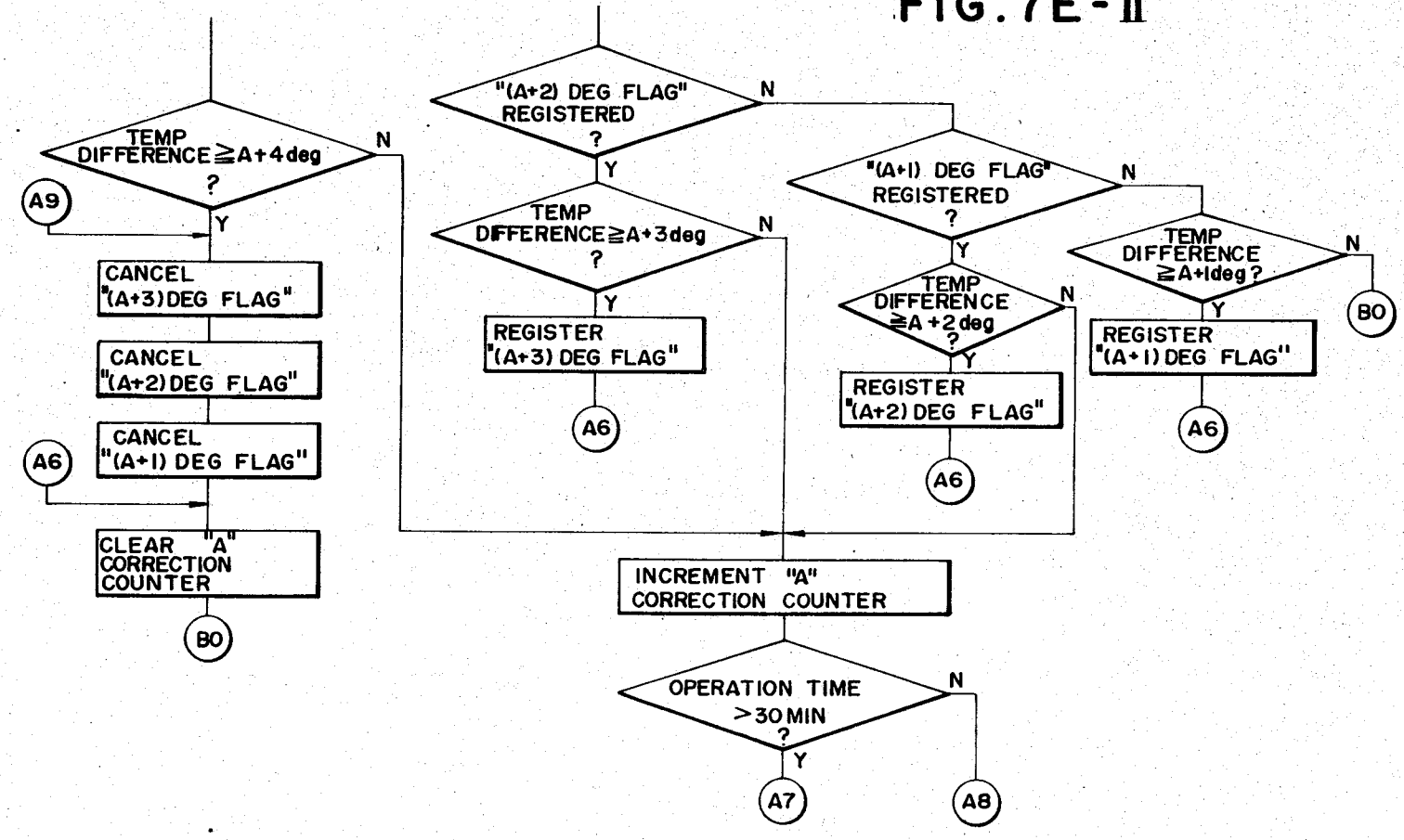

FIG. 7G-I
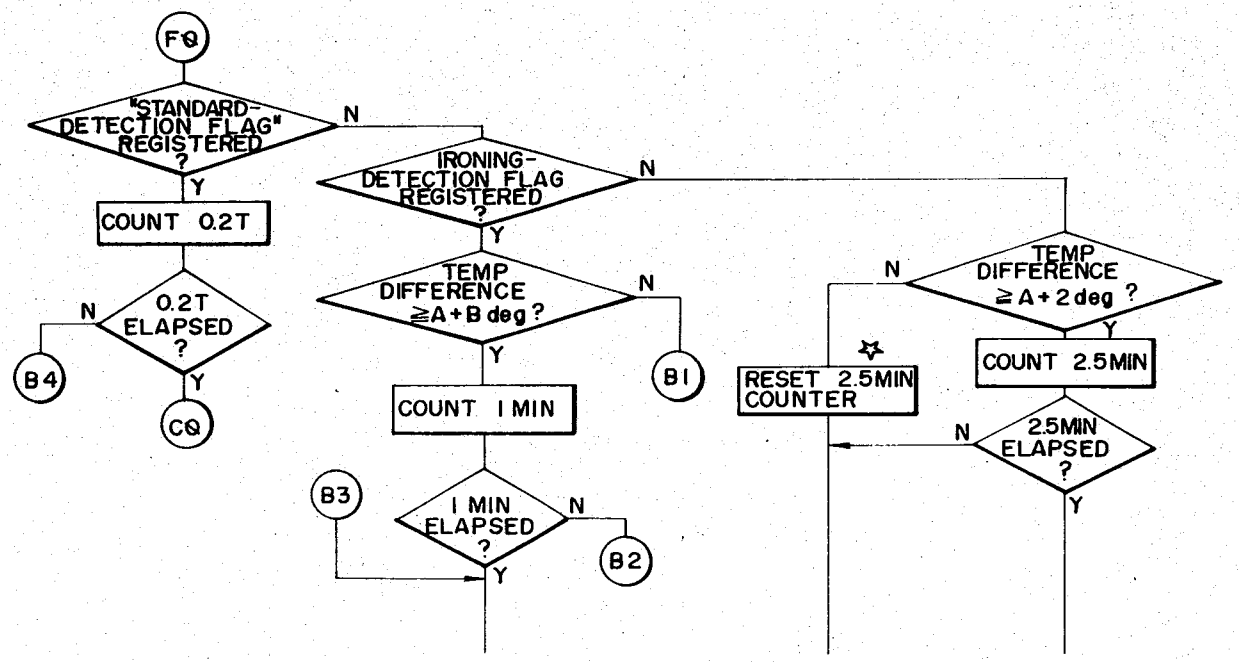

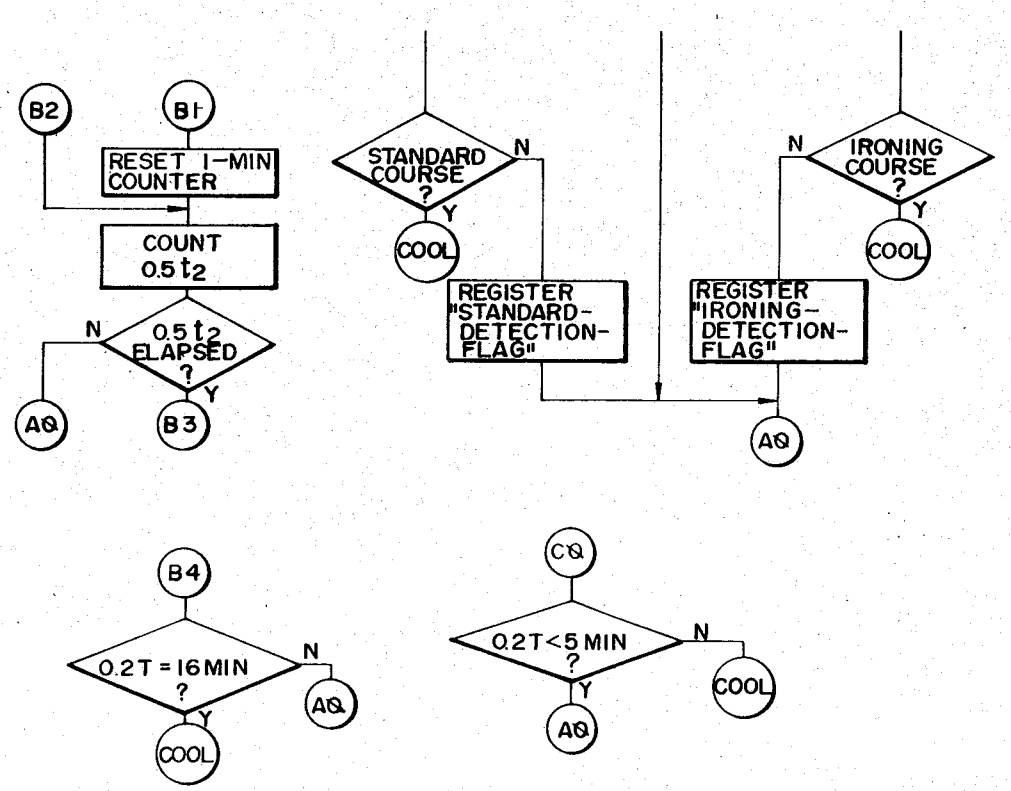
FIG. 7G-II

CLOTHES DRYER

FIELD OF THE INVENTION

This invention relates to a clothes dryer of the type in which exhaust air from its drying space is dehumidified by a process of heat exchange using external air, and the dehumidified air is reheated and returned to the drying space again. More precisely, the present invention relates to a clothes dryer of the above type in which the user of the dryer does not have to manually set the duration of drying operation, that is, the dryer is provided with an automatic function for automatically controlling the duration of the drying operation.

DESCRIPTION OF THE PRIOR ART

A clothes dryer of this kind is known as disclosed in, for example, Japanese Patent Early Publication No. 58-173599. According to the known clothes dryer, the clothes dryer includes an inlet and outlet communicating with its drying space, and measures the difference between the temperatures at the inlet and outlet of its drying space so as to control the drying operation in which a constant-rate drying period shifts to a falling-rate drying period.

It is commonly known that, when a clothes dryer starts its drying operation, the internal temperature of its drying space containing clothes rises initially to show a sharp increase in the temperature difference described above, and, thereafter, the temperature difference is maintained constant for some time due to evaporation of moisture from the clothes. This period of time is referred to herein as a constant-rate drying period. When the drying operation by heated air is further continued, evaporation of moisture ceases, and the temperature difference increases again. This latter period of time is referred to herein as a falling-rate drying period.

In the known clothes dryer, the temperature difference between the inlet and outlet of the drying space is measured at a predetermined time after the starting of the drying operation to be taken as a reference value, and the drying operation terminates as soon as the temperature difference measured in the falling-rate drying period exceeds a setting which represents the sum of the reference value and a predetermined value.

However, the prior art clothes dryer has inherent drawbacks defective in that underdrying or overdrying tends to occur because it is not adapted for making such a precise control that the duration of drying by heated air is regulated depending on the quantity or kind of articles of fabric to be dried. For example, when the wash load is light, that is, when several towels or handkerchiefs only are its load, the temperature difference starts to increase sharply from the beginning of the drying operation until finally the setting of the temperature difference is reached without any intermediate period of balancing between the heat and the evaporating moisture. Consequently, the timing of completing the drying operation has not been exactly determined, and the automatic operation has accompanied a wasteful or useless operating period of time. Also, when the wash load includes a number of pieces of clothing bunched together, the blast or stream of heated air tends to be directly discharged from the outlet without passing through the clothes, resultinhg in underdrying of the clothes. Further, when the load is in the form of special clothes such as jeans, the measured temperature difference tends to increase progressively in the constant-rate drying period. Therefore, the prior art clothes dryer in which the reference value is varied in accordance with the actually measured temperature difference may not terminate the drying operation at the proper time, resulting in overdrying of the clothes.

SUMMARY OF THE INVENTION

It is a primary object of the present invention to provide a clothes dryer in which the end of the drying operation by heated air is automatically controlled without regard to the quantity and quality of clothes to be dried and also independently of whether the temperature of external air is high or low, so that the clothes can be reliably dried to the desired optimum condition, and such clothes can be taken out at the end of the drying operation.

In accordance with the present invention which attains the above object, there is provided a clothes dryer of the dehumidifying type in which exhaust air from a drying space defined by the dryer's tumbling drum, which receives a load of wash to be dried is subjected to a heat exchange using external air for removing moisture from the exhaust air after being re-heated by a heat source, the exhaust air is returned to the drying space by a fan unit so as to dry the load by heated air. The clothes dryer of the present invention includes:

(a) first heat-sensitive means for measuring the temperature of exhaust air at an outlet of the drying space;

(b) second heat-sensitive means for measuring the temperature of the exhaust air after having been subjected to the heat exchange with external air or the temperature of the external air after having been subjected to the heat exchange with the exhaust air;

(c) memory means for storing, as a reference value A, the difference between the temperatures measured by the first and second heat-sensitive means at a predetermined time after the starting time of the drying operation; and (d) control means for the heat drying operation so that it can terminate when the later relation between the reference value A and the temperature difference which has varied after the predetermined time, comes to a predetermined value which is variable depending on the quantity and kind of loads to be dried.

In the clothes dryer of the present invention, it is preferable that the reference value A is first compared with the measured temperature difference at a rate of a first cycle from a first predetermined time to a first specified time, and is then compared with the measured temperature difference at a rate of a second cycle after the first specified time, so that the reference value A can be changed depending on the result of comparison. By so changing the reference value A, the operation ending temperature can be accurately determined even when the measured temperature difference increases gradually or slowly in the falling-rate drying period.

Further, when the measured temperature difference is larger than the reference value A, the present invention preferably causes the reference value A to be progressively increased. The effect of this is to minimize one of the inherent drawbacks of a conventional clothes dryer, which replaces the reference value with the smallest temperature difference, which would terminate the drying operation prematurely when the temperature difference should increase to a higher level, resulting in underdrying the clothes.

Further, when the measured temperature difference continues to be smaller than the reference value A for a second predetermined period of time, according to the present invention the reference value A is preferably replaced by the specific, measured temperature difference smaller than that. Thus, the drying operation will be able to adjust for variations of the ambient air temperature.

In the clothes dryer of the present invention, the drying operation may be controlled to terminate when the reference value A is larger than a second reference value which is a predetermined constant, so that even when the load is too light to require the falling-rate drying period, the drying operation can terminate without causing overdrying of the load.

The clothes dryer of the present invention also preferably terminates the drying operation by heated air when the measured temperature difference has exceeded the reference value A by more than a predetermined value at the end of a drying operation period of time, and after an additional period of time corresponding to a predetermined percentage of the drying operation period of time has elapsed, so that the drying operation can reliably terminate while drying clothes at the desired rate of dryness without causing overdrying or underdrying of the clothes.

The clothes dryer of the present invention also preferably terminates the drying operation by heated air when the measured temperature difference has attained the sum of the reference value A and a predetermined value B, which varies in accordance with length of time that has elasped from the starting time of the drying operation to the end of a specified period of time after the starting time, or when an extended additional period of time corresponding to a predetermined percentage of the drying operation period of time T elapsed up to that time has then elapsed, so that the additional operation period of time can be properly determined to meet a specific load, and the load can be dried at the desired high rate of dryness. In this case, the additional operation period of time is preferably limited between a predetermined maximum and a predetermined minimum so as to eliminate any excess and deficiency of the drying period of time and to properly carry out the desired drying operation by heated air.

In the clothes dryer of the present invention, it is preferable that the drying operation by heated air is controlled to terminate when the temperature difference measured by the first heat-sensitive means continues to exceed a predetermined upper limit for a specified length of time, or when the measured temperature difference continues to exceed a predetermined maximum for a specified length of time, so that the desired drying operation can be properly carried out regardless of the temperature of the external air.

In the clothes dryer of the present invention, it is further preferable that the drying operation by heated air is halted temporarily when the door of the drum (defining the drying space) is opened, so as to ensure the safety of the user. In this case, it is preferable that, when the measured temperature difference continues to be smaller than the reference value A for a predetermined period of time, the reference value A is replaced by the specific, measured temperature difference. Thus, even when the door is opened in the course of the drying operation or when the door is opened to load additional clothes during the drying operation, the opening of the door can be detected to properly determine the operation ending timing, to prevent the drying operation terminating prematurely and not sufficiently drying the initially loaded clothes or the added clothes.

BRIEF DESCRIPTION OF THE DRAWINGS

FIGS. 7(A) to 7(G) are a flow chart for illustrating the operation of the clothes dryer shown in FIG. 1.

DESCRIPTION OF THE PREFERRED EMBODIMENT

Figure 1:
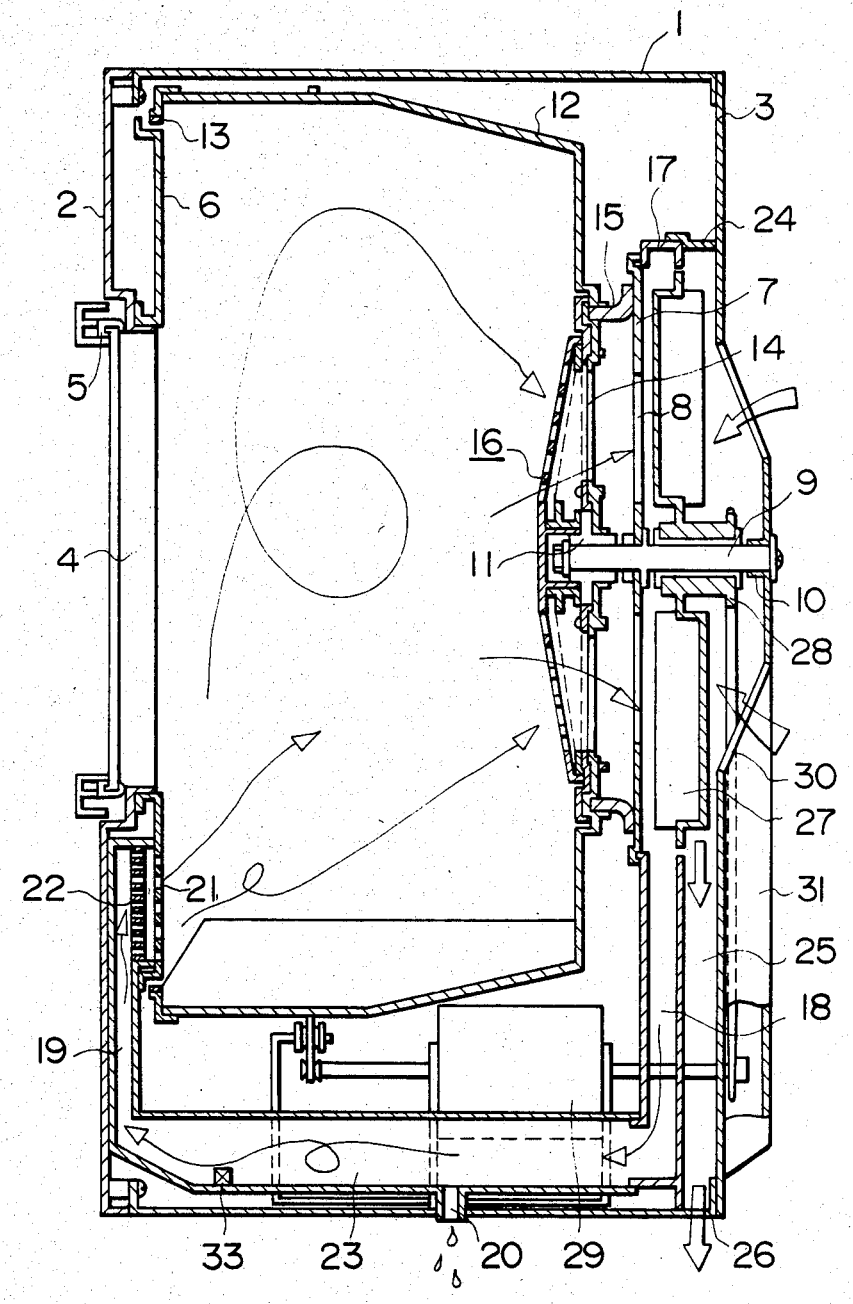
FIG. 1 is a sectional, side elevation view of a preferred embodiment of the clothes dryer according to the present invention.
Figure 2:
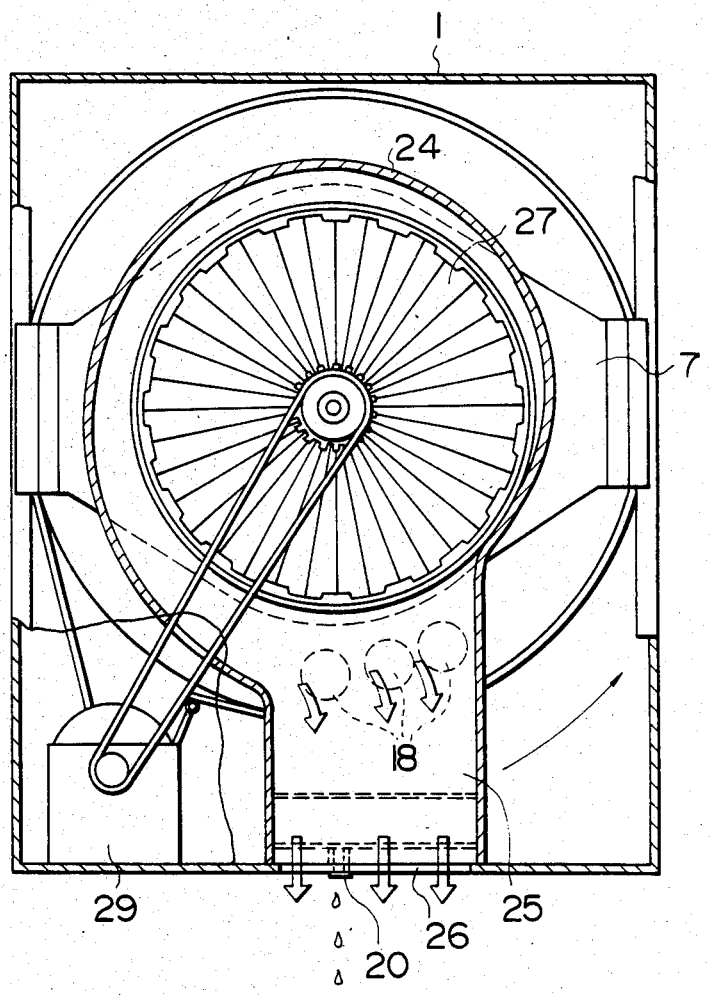
FIG. 2 is a partly sectional, rear elevation view of the clothes dryer shown in FIG. 1.
Figure 3:
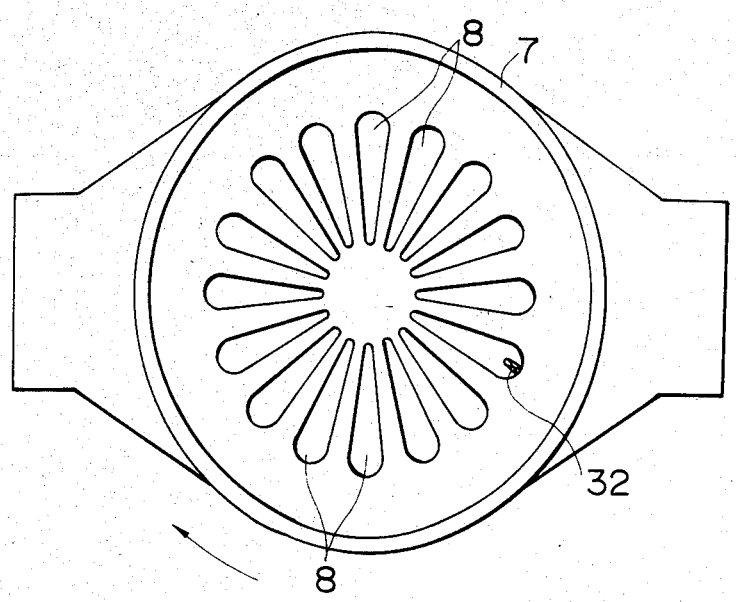
FIG. 3 is an internal view of part of the clothes dryer shown in FIG. 1.

Referring to FIGS. 1, 2 and 3 showing the structure of a preferred embodiment of the clothes dryer according to the present invention, the clothes dryer includes a dryer housing 1 made of a metal, and a front panel 2 made of a resin material and a rear panel 3 made of a metal are secured to the edges of the front and rear openings respectively of the dryer housing 1. The front panel 2 is formed with a clothes insertion and withdrawal opening 4 which may be opened and closed by a door 5. An annular drum support member 6 made of a metal is disposed in the front internal space of the dryer housing 1 and is secured to the dryer housing 1 and front panel 2. On the other hand, a partition member 7 made of a metal is disposed in rear internal space of the dryer housing 1. Both of the drum support member 6 and the partition member 7 are formed of thick metal plates, and the partition member 7 is fixed at its lateral ends thereof in the both side walls respectively of the dryer housing 1. The partition member 7 is formed with a plurality of ventilation apertures 8 extending radially from the center thereof as best shown in FIG. 3.

An elongate shaft 9 extends in the transverse direction through the center of the partition member 7 and is fixed in position. The rear end of the shaft 9 is secured by a bolt and a washer to a boss 10 formed at the center of a central rearwardly projecting portion of the rear panel 3. A bearing 11 is rotatably fitted on the front end of the shaft 9, and a drum 12 is fixedly mounted on the bearing 11. The drum 12 cooperates with the door 5 and the drum support member 6 to define a drying space. The bearing 11 itself is anchored in position by a bolt and a washer so that it may not escape from the shaft 9. A sealing member 13 of felt or like material is provided on the peripheral edge of the front opening of the drum 12 to make rotational sealing engagement with the outer peripheral edge of the drum support member 6. The rear wall of the drum 12 is formed with a plurality of apertures or radial slits which serve as an outlet 14 of heated air. Another sealing member 15 of felt or like material is fixed as by an adhesive to the outer surface of the rear wall of the drum 12 adjacent to the outer peripheral portion of the heated air outlet 14 of the drum 12 to make sliding sealing engagement with the front surface of the partition member 7. A filter 16 covering the drum outlet 14 is mounted on the inner surface of the rear wall of the drum 12.

A cylindrical circulation casing 17 is attached airtight to the rear surface of the partition member 7. This circulation casing 17 is in the form of a resin molding, and a downwardly extending circulating conduit 18 disposed in the rear internal space of the dryer housing 1 is formed integrally with the circulation casing 17. This circulating conduit 18 is connected at a portion of the bottom of the dryer housing 1 to an L-shaped duct 19 secured to the drum support member 6. From a portion of the bottom of the duct 19, a drain pipe 20 protrudes downward to the exterior of the clothes dryer.

The drum support member 6 is formed at its lower portion with an inlet 21 of heated air into the drum 12, and a honeycomb-structure heater 22 in the form of a positive temperature coefficient thermistor(PTC thermistor) is disposed at the outlet of the duct 19 opposite to the heated air inlet 21 of the drum 12.

Thus, a path 23 of heated air circulation is formed such that heated air in the drum 12 passes through the filter 16 to be exhausted from the drum outlet 14, and, while being sealed by the sealing member 15, passes through the ventilation apertures 8 formed in the partition member 7 and thence through the circulating conduit 18, duct 19 and heater 22 to be circulated into the drum 12 again through the heated air inlet 21.

A cooling casing 24 made of a resin material and having the substantially same shape as the circulation casing 17 is secured to rear surface of the circulation casing 17 in a relation contiguous to the latter. A downwardly extending exhaust conduit 25 is formed integrally with the circulating duct 18 in a relation isolated from the latter and communicates with an exhaust port 26 provided at a portion of the bottom of the dryer housing 1. Both of the cooling casing 24 and the exhaust conduit 25 are covered at their rear portions by the aforementioned rear panel 3.

A heat-exchanger fan 27 having impeller blades on its both sides is disposed so as to straddle the circulation casing 17 and cooling casing 24 and is rotatably mounted on a rear portion of the shaft 9 through a bearing metal pad. A pulley 28 for rotation transmission is provided in a relation contiguous to or integral with the heat-exchanger fan 27 and is connected through a belt to motor 29 disposed on the inner bottom portion of the dryer housing 1. Therefore, the motor 29 acts to rotate the heat-exchanger fan 27 and acts also to rotate the drum 12 through pulleys including idler pulley and through a belt.

The rear panel 3 is formed at its central rearward projecting portion with a plurality of radial air-intake apertures 30, and a cover 30 which is also an extension of the rear panel 3 covers the belt connected between the pulley 28 and the motor 29.

As clearly shown in FIG. 3, a first thermistor 32 for detecting the temperature of exhaust air at the air outlet 14 of the drum 12 is disposed on the rear surface of the partition member 7. On the other hand, a second thermistor 33 for detecting the temperature of exhaust air after having been subjected to heat exchange and dehumidification is disposed in the duct 19 as shown in FIG. 1. This second thermistor 33 may detect the temperature of external air having been subjected to heat exchange by the heat-exchanger fan 27. Also, when a dehumidifier is separately provided, the second thermistor 33 may detect the temperature of external cooling air having been passed through the dehumidifier.

Figure 4:
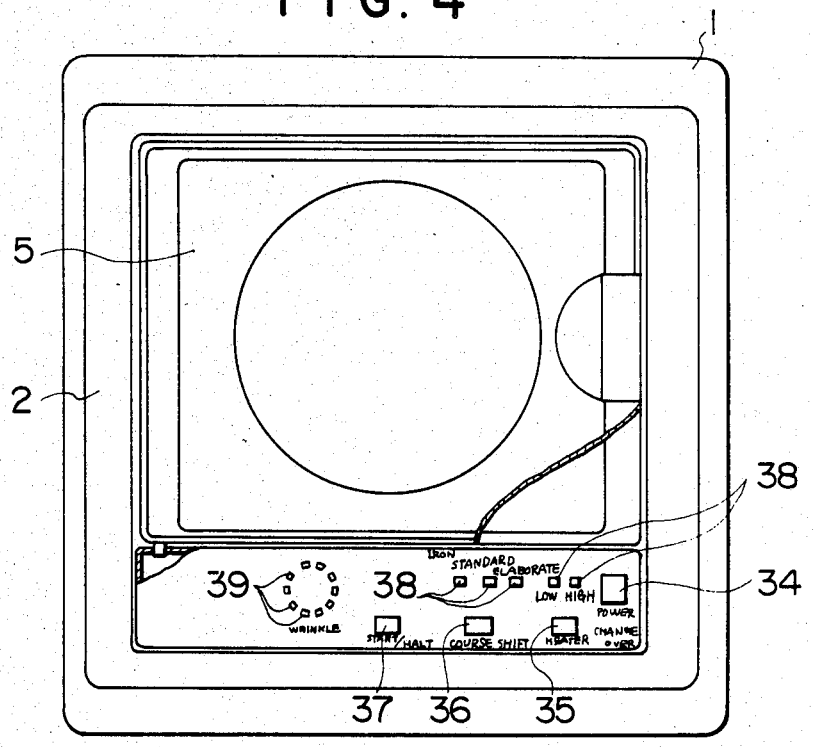
FIG. 4 is a front elevation view of the clothes dryer shown in FIG. 1.

Referring to FIG. 4, disposed on the front panel of the clothes dryer are an on-off button 34 for a power switch, an actuation button 35 for actuating a switch which changes over the capacity or thermal output of the heater 22 between its high and low levels when depressed sequentially, an actuation button 36 for actuating a switch which changes over or causes a shift between three drying courses, that is, a standard course, an elaborate course, and an ironing course in the above order when depressed sequentially, and an actuation button 37 for actuating a start/halt switch. Besides the three courses described above, a course which instructs an operation time of, for example, 60 minutes may also be provided. Disposed also on the front panel of the clothes dryer are light-emitting diodes 38 which are selectively energized or flicker to display whether the heater 22 is operating in its high or low output level and to display which one of the three courses is selected. Disposed also on the front panel are light-emitting diodes 39 arranged in a ring pattern to be sequentially energized and de-energized during the process of anti-wrinkle for preventing wrinkles.

Figure 5:
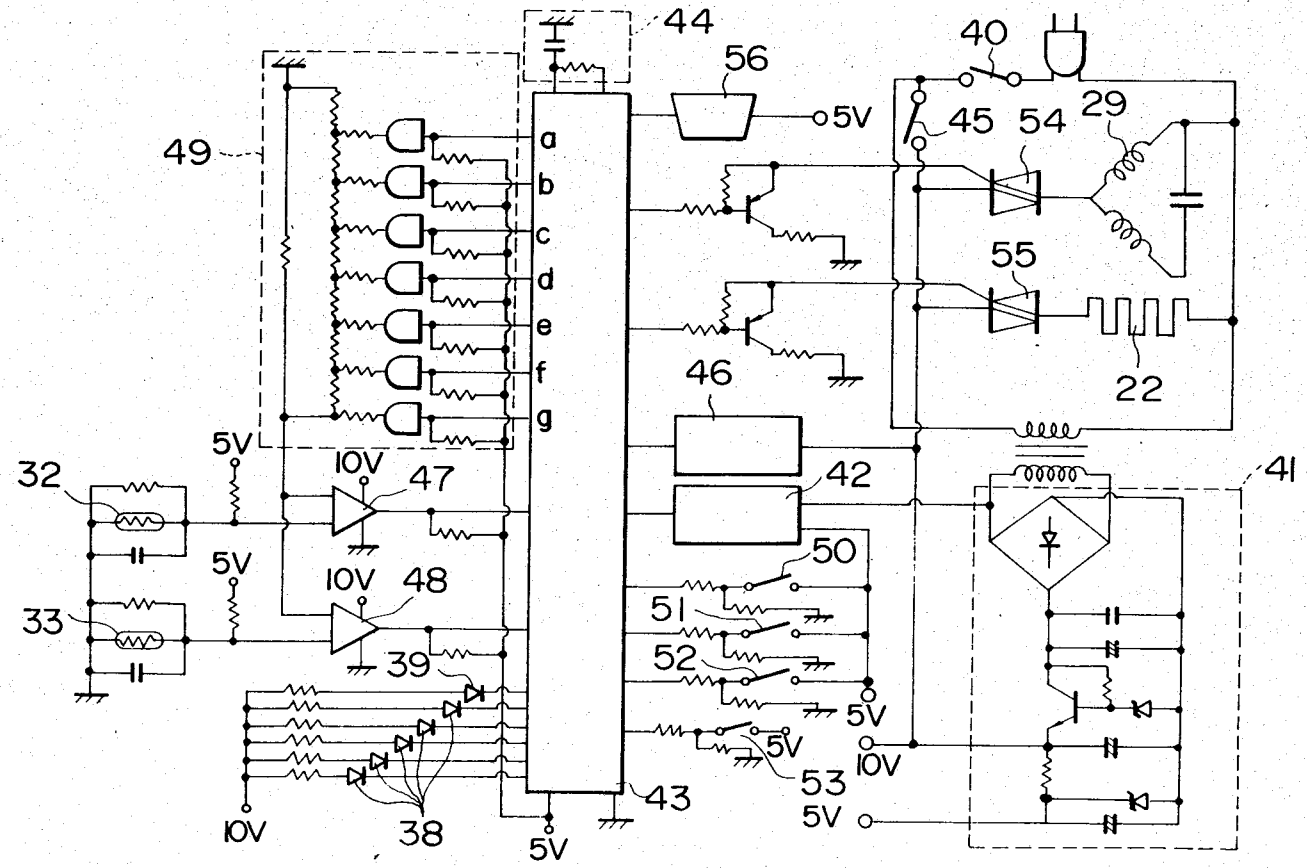
FIG. 5 is an electrical circuit diagram of the clothes dryer shown in FIG. 1.

Referring to FIG. 5, an AC voltage from a commercial power source is supplied through a power switch 40 to a rectifier circuit 41. A portion of the AC voltage supplied to the rectifier circuit 41 is converted into a rectangular pulse signal by a waveform shaping circuit 42, and such a pulse signal is applied to a microcomputer 43 to be utilized as a time-counting signal. The microcomputer 43 stores program which proceeds in response to clock pulses applied from a clock oscillator circuit 44.

In response to the depression of the power switch 40, a reset pulse is applied to the microcomputer 43 through an initial resetting circuit 46. In response to the application of this reset pulse, the program stored in the microcomputer 43 is initialized.

Voltage comparator circuits 47 and 48 are connected to the microcomputer 43. The outputs of the aforementioned first and second thermistors 32 and 33 are applied, after being voltage-divided by resistors, to one of the input terminals of the voltage comparator circuits 47 and 48, respectively. A ladder circuit 49, which generates a staircase waveform in response to an input applied from the microcomputer 43, applies its output signal to the other input terminal of each of the voltage comparator circuits 47 and 48. The ladder circuit 49 is connected to output terminals a to g of the microcomputer 43 so that the output signal of the laddear circuit 49 changes stairwise in response to the sequential appearance of an output signal from the individual output terminals a to g of the microcomputer 43. When the voltage comparator circuits 47 and 48 are turned on to apply their output signals to the microcomputer 43, the microcomputer itself 43 identifies that such specific output signals are generated from the voltage comparator circuits 47 and 48 in response to the appearance of the specific output signals from the associated ones of the output terminals a to g, so that the temperatures detected by the respective thermistors 32 and 33 can be identified.

Connected also to the microcomputer 43 are a second door switch 50 which is turned on or off depending on whether the door 5 is closed or not, a course shift switch 51 for causing a shift between the drying courses, a start/halt switch 52, and a switch 53 for changing over the capacity or thermal output of the heater 22 between its high and low levels.

The motor 29 is connected to the commercial power source when an output signal from the microcomputer 43 turns on a triac 54 under the condition in which both of the power switch 40 and a first door switch 45 are turned on already. The heater 22 is also connected to the commercial power source when the triac 54 is turned on in response to the input signal applied from the microcomputer 43. A buzzer 56 informing the end of the drying operation is also connected to the microcomputer 43.

Thus, during the drying operation, both the heater 22 and the motor 29 are energized, and both the fan 27 and the drum 12 are rotated.

Drying air heated by the heater 22 circulates in the order of the drum inlet 21, drum 12, filter 16, drum outlet 14, ventilation apertures 8, fan 27, circulation casing 17, circulation conduit 18, duct 19, and the heater 22, thereby drying clothes contained in the drum 12. On the other hand, external air flows in the order of the intake apertures 30, cooling casing 24, fan 27, exhaust conduit 25, and the exhaust port 26.

Heat exchange between drying air and external air is effected at the front and rear sides of the fan 27, and moisture expelled from the clothes by the drying air is separated in the duct 19 to be discharged as drain from the drain pipe 20, while the drying air having a reduced humidity is circulated along the circulation path again.

The sealing member 15 rotating with the drum 12 makes sliding sealing engagement with the front surface of the partition member 7 to attain its sealing function for drying air. Also, any extraneous air borne material such as lint liberated from the clothes is removed by the filter 16.

Figure 6:
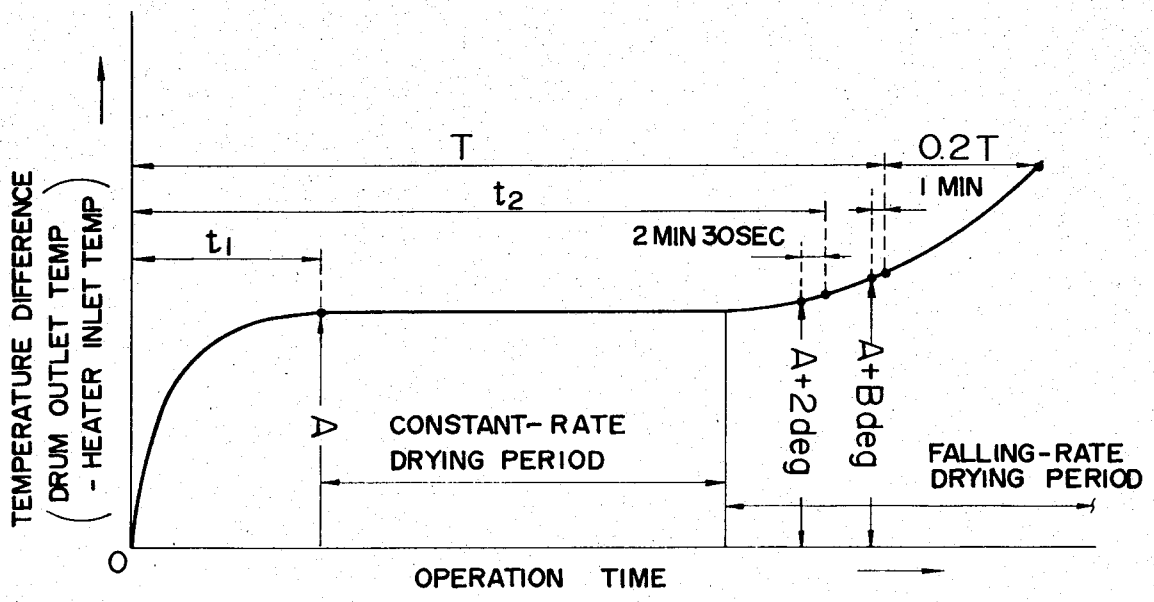
FIG. 6 is a graph showing the relation between the temperature difference and time when the clothes dryer shown in FIG. 1 is loaded with an ordinary load.

Before describing the controlled operation of the clothes dryer of the present invention with reference to a flow chart, how the temperature difference detected by the first and second thermistors 32 and 33 changes relative to the operation time will be explained with reference to FIG. 6. Although the above relation differs depending on the kind and quantity of clothes to be dried, FIG. 6 shows a most general example of such a relation. It will be seen in FIG. 6 that the internal temperature of the drum 12 and the temperature of clothes, hence, the temperature difference between the drum outlet and the heater inlet increases until an operation period of time $t_1$ has elapsed. Thereafter, there is a constant-rate drying period in which moisture in the clothes is continuously evaporated, the temperature difference is maintained substantially constant. When the moisture is removed to a greater extent, the temperature difference shows an increase again. The degree percentage of dryness of the clothes is 85% to 90% at the time at which the temperature difference starts to increase again past the constant-rate drying period. This percentage is suitable for ironing. The above period is followed by a falling-rate drying period in which the temperature difference continues to increase, and the percentage of dryness is about 100% when the temperature difference increases up to a predetermined value. Therefore, a further continuation of the drying operation is primarily useless.

Therefore, it is the fundamental idea of the present invention that the temperature difference detected at the end of the operation time $t_1$ or at the beginning of the constant-rate drying period is stored as a reference value A in the microcomputer 43, and the heat drying operation terminates as soon as the temperature difference increases by a predetermined value B from the reference value A, that is, as soon as the temperature difference attains the level of (A+B).

Figure 7A:
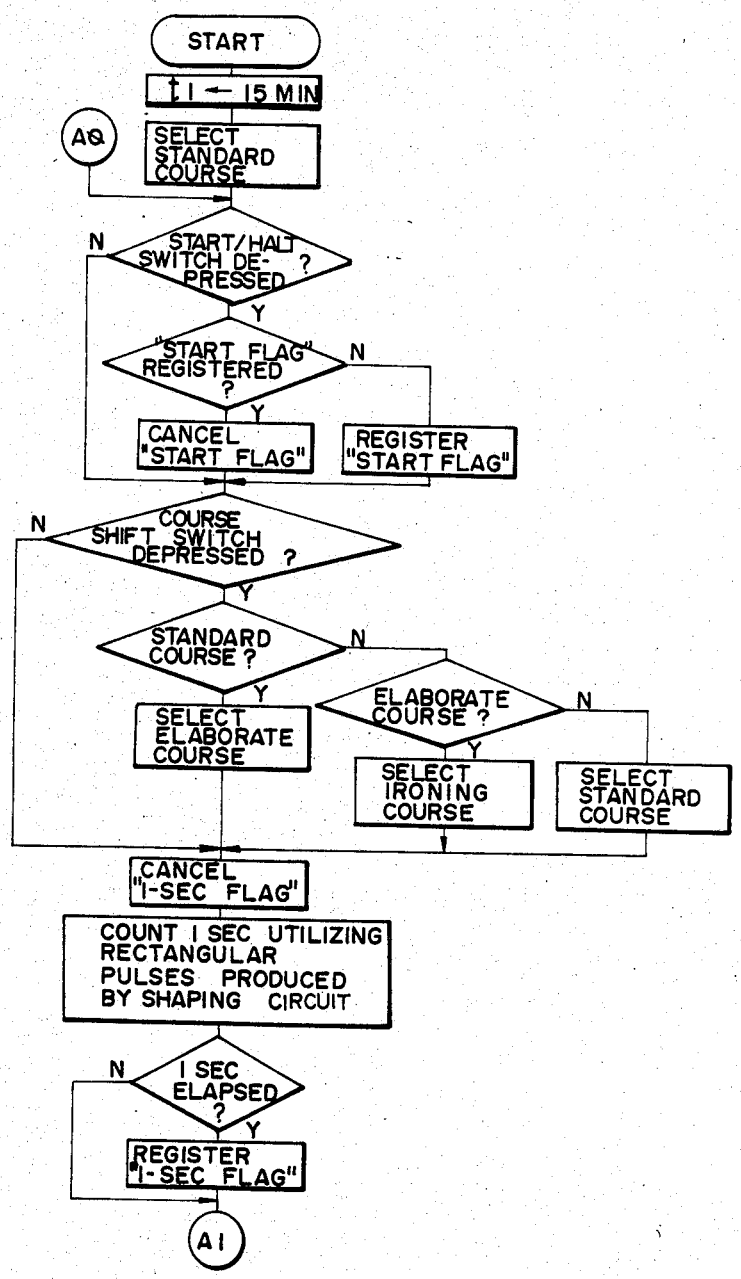

Upon turning-on the power switch 40, the operation period of time $t_1$ is set at 15 minutes, and a course is set at the standard one, as shown in FIG. 7A. Since no flags are registered at this time, the program proceeds through A1 to return to A0 in FIGS. 7A and 7B, and such a sequence is repeated. In the present invention, the operation period of time $t_1$ is selected at the value of 15 minutes as a result of various tests. Then, the operation course is selected, and the start/halt switch 52 is depressed. Each time the start/halt switch 52 is depressed or actuated, one of two states is established, that is, a "start flag" is registered or cancelled. Also, each time the course shift switch 51 is depressed or actuated, a shift from the standard course to the elaborate course, from the elaborate course to the ironing course, and from the ironing course to the standard course occurs.

The operation period of time is counted at a time interval of about 1 second. That is, when, for example, the power source frequency is 50 Hz, the waveform shaping circuit 42 convents the AC voltage into a rectangular pulse signal having a pulse interval of 20 msec and applies such a signal as an interrupt pulse input to the microcomputer 43. On the other hand, the microcomputer 43 executes processing of each step of the program on the basis of the clock signal generated from the clock oscillator 44, and, thus, the microcomputer 43 executes processing of even the longest routine of the program within a period of time of 5 msec. Therefore, the microcomputer 43 receives the interrupt pulse by its processing means provided for "counting 1 second utilizing the rectangular pulses produced by the shaping circuit" shown in FIG. 7A, and its 1-sec counter counts up one in response to the reception of each pulse. Thus, when the interrupt processing is executed 50 times, 1 second is counted.

When the "start flag" is registered already, a decision is made in FIG. 7B as to whether or not the door 5 is closed. When the result of a decision proves that the door 5 is closed, the program shifts to A2 in FIG. 7C after confirming the fact that an "air blast flag" indicating supply of an air blast only is not registered. Then, an "operation start flag" is registered, a "correction flag" is cancelled, and the motor 29 is energized. Then, the temperature at the outlet 14 of the drum 12 and that at the inlet of the heater 22 are measured by the first and second thermistors 32 and 33, respectively, and the data of the temperature difference therebetween is stored in an random access memory (RAM) in the microcomputer 43. A "stop flag" is not registered, and the time counted at the time interval of 1 second is also counted in terms of minutes too. Then, the heater 22 is energized as shown at A4 in FIG. 7D. Further, as shown at A3 in FIG. 7C, the above manner of control is repeated to continue the drying operation by heated air until the operation period of time $t_1$ of 15 minutes is reached. Upon lapse of the operation period of time $t_1=15$ minutes, the measured temperature difference at that time is selected as a first reference value A, and the predetermined value B is set at 5 degrees. Then, an "A read flag" indicating reading of the above temperature difference A is registered. When the operation period of time exceeds 15 minutes and reaches 20 minutes, the predetermined value B is replaced by a new value which is larger by 2 degrees than the previous value. That is, the predetermined value B is now set at 7 degrees. Thereafter, the predetermined value B is replaced by values which are larger by 2 degrees than the preceding values upon each lapse of 30 minutes, 40 minutes, and 60 minutes. The maximum of the predetermined value B is 13 degrees. The predetermined value B is replaced in the manner described above in order to prevent the so-called non-uniform drying due to the presence of local insufficiently dried portions which may result even when the temperature at the drum outlet 14 may moderately rise during drying a heavy load. That is, the predetermined value B is gradually increased to meet the gradual increase in the measured temperature difference, so that the operation period of time can be set at the proper value corresponding to the load of the clothes dryer.

Figure 7C:
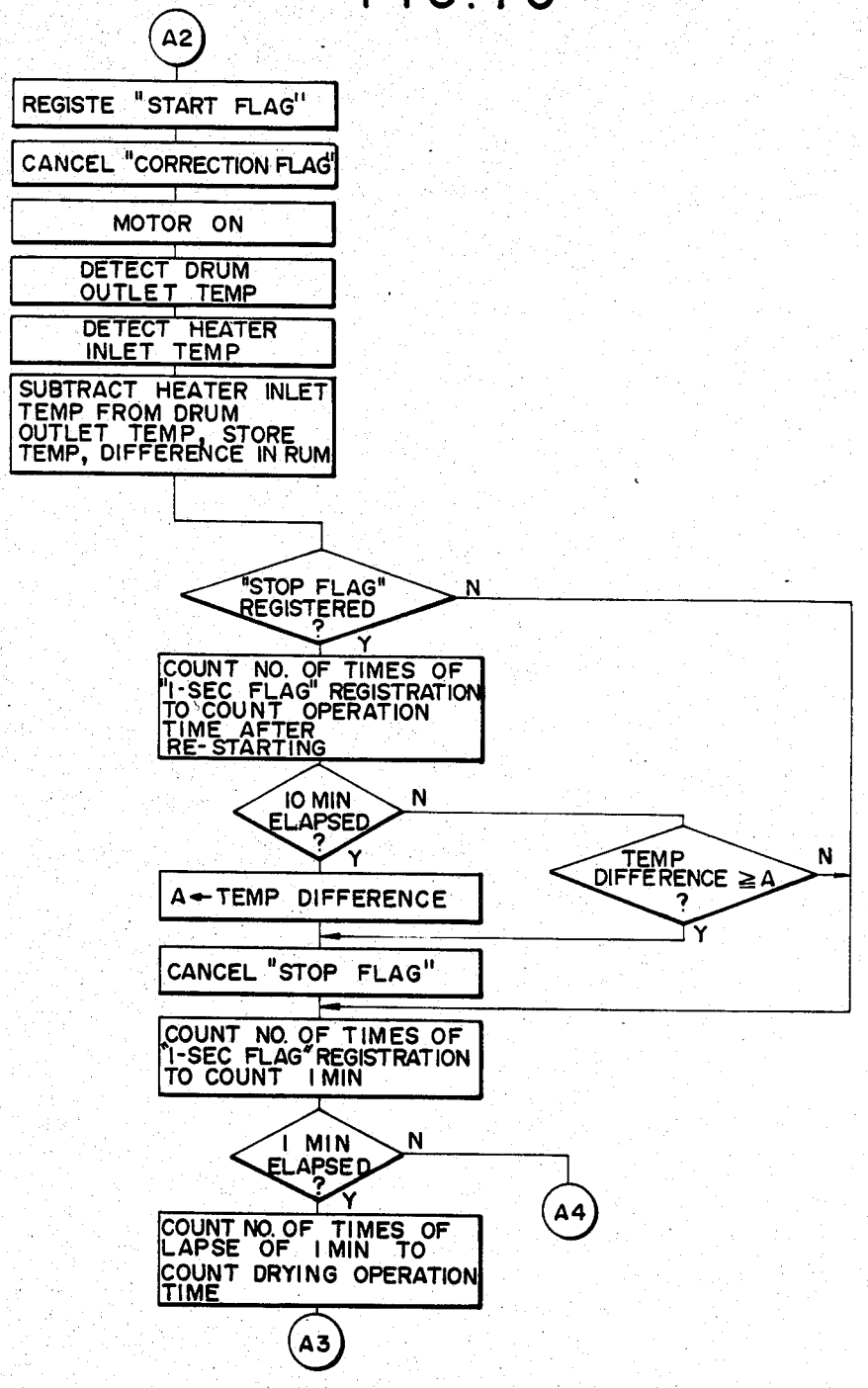
Figure 7D:
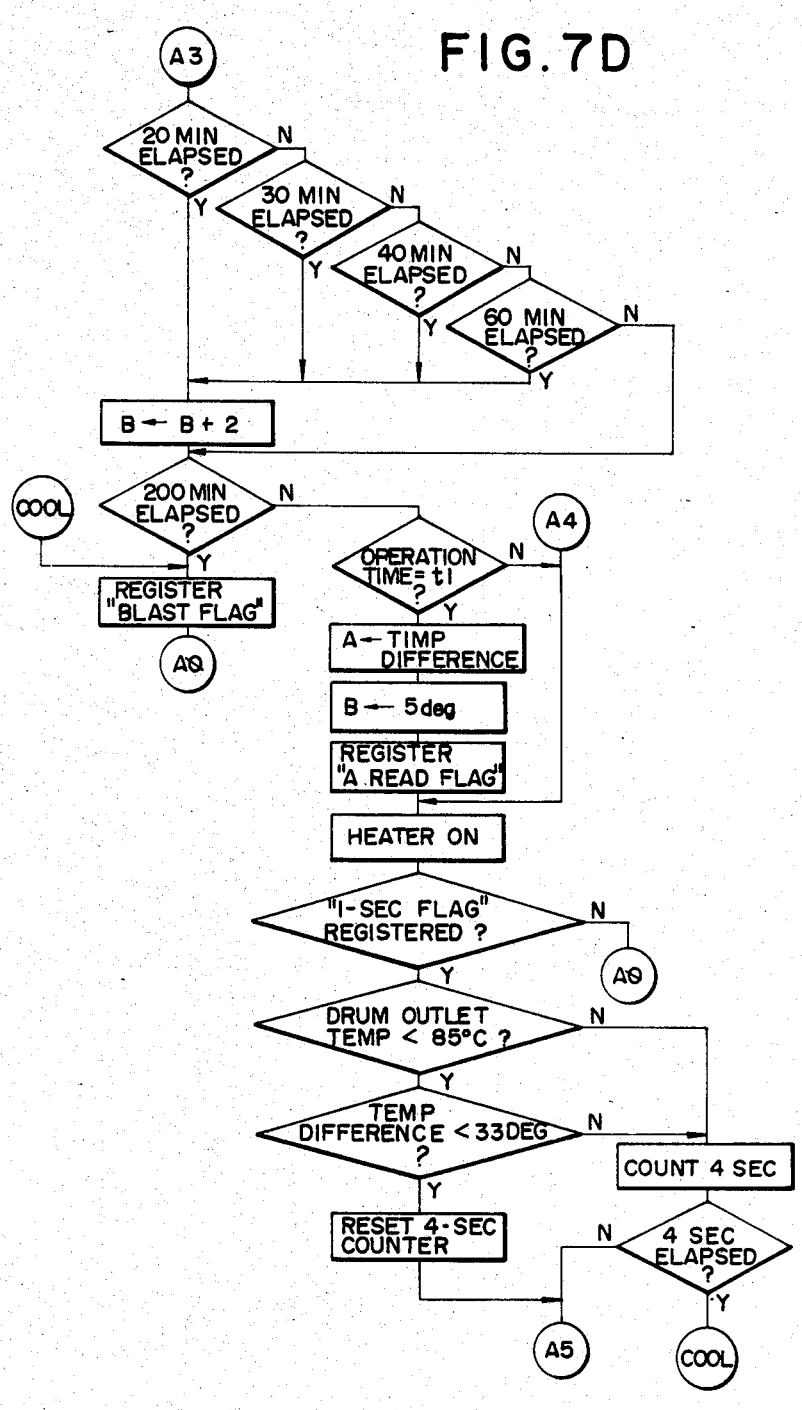

During the above manner of drying operation, the temperature at the drum outlet 14 and the temperature difference between the drum outlet 14 and the heater inlet are continuously measured. When the temperature at the drum outlet 14 continues to be higher than 85° C. for more than 4 seconds or when the measured temperature difference continues to be larger than 33 degrees for more than 4 seconds, the microcomputer 43 determines that the clothes dryer is not loaded (a "no-loaded" condition) and the operation mode shifts to the cooling mode without regard to the operation period of time. The "air blast" flag is now registered, and the program returns to A0 in FIG. 7A. When the ambient temperature is low, the temperature at the outlet 14 of the drum 12 rarely exceeds 85° C., but the measured temperature difference tends to exceed 33 degrees. On the contrary, when the ambient temperature is high, the temperature at the outlet 14 of the drum 12 tends to exceed 85° C. Thus, the no-loaded condition can be accurately detected by one of the above means throughout the four seasons. Further, when the duration of the drying operation by heated air exceeds 200 minutes, the "air blast flag" is also registered, as shown in FIG. 7D, for ensuring the safety, and the program returns to A0 in FIG. 7A.

When the drying operation proceeds smoothly as scheduled, the "A read flag" is registered already, while the "stop flag" is not registered as shown in FIG. 7E. The microcomputer 43 decides as to whether or not the ironing course is selected and as to whether or not the operation period of time exceeds 30 minutes. When the result of the decision is that the operation period of time exceeds 30 minutes, a decision is made as to whether or not the temperature difference A is $A \geqq 25$ degrees. When the selected course is identified as the ironing course, whether or not the value of the temperature difference A is $A \geqq 25$ degrees (a second reference value) is determined from the time at which reading of the temperature difference A is started, that is, at the time at which the operation period of time exceeds 15 minutes. When the heater 22 is set to operate at its low output level, the above decision is based on whether or not A is $A \geqq 17$ degrees. Such reference values are set to deal with the case in which the load of the clothes dryer is very light. Thus, when the measured temperature difference A does not reach the above level or when the operation period of time does not exceed 30 minutes in the course other than the ironing course, and when the "correction flag" for correcting the first reference value A is not registered, the program shifts to B0 in FIG. 7E.

When the measured temperature difference A is determined to be $A \geqq 25$ degrees (17 degrees), it indicates that the load is light, and the cooling mode starts to finally complete the drying operation in the case of the course other than the elaborate course. Further, in the case of the elaborate course, an "ironing detection flag" is registered, and the program shifts to B3 in FIG. 7G to register a "standard detection flag". Then, the program shifts to F0 in FIG. 7G via B0 in FIG. 7E and 7F. After the clothes dryer further operates for an additional period of time corresponding to 20% of the operation period of time T elapsed up to that time or 0.2T, the operation mode shifts to the cooling mode.

When the temperature difference A is determined to be $A<25$ degrees (17 degrees) and, as a result the program shifts to B0, it is a common practice that the program shifts to F0 to decide whether or not the "standard detection flag" is registered, whether or not the "ironing detection flag" is registered, and whether or not the measured temperature difference is more than $(A+2)$ degrees. When it is determined that the measured temperature difference is less than $(A+2)$ degrees, the above manner of control is repeated. When, on the other hand, the measured temperature difference is determined to be more than $(A+2)$ degrees, a period of time of 2 minutes and 30 seconds is counted. When the measured temperature difference continues to be more than $(A+2)$ degrees throughout this period, a decision is made as to whether or not the selected course is the ironing course upon lapse of the above period, and the cooling mode starts when the course is identified as the ironing course. On the other hand, when the course is not identified as the ironing course, the "ironing detection flag" is registered. The operation period of time up to that time is $t_2$. After registering the "ironing detection flag", a determination is made as to whether or not the measured temperature difference is equal to or more than $(A+B)$ degrees. When the above relation continues for 1 minute, the cooling mode starts thereafter in the case of the standard course, while the "standard detection flag" is registered in the case of the other courses. Registering of the "standard detection flag" indicates that the selected course is the elaborate course. The drying operation further continues for a period of time corresponding to 20% of the operation period of time T elapsed up to that time including the period of 1 minute, and, then, the cooling mode starts.

Upon starting of the cooling mode, the "air blast flag" is registered, and the heater 22 is de-energized as shown in FIG. 7B. The motor 29 is also de-energized when a period of time of 5 minutes elapses after that, or when the temperature at the outlet 14 of the drum 12 drops to lower than 40° C. This is the so-called "cool-down" step for cooling the heated clothes. Then, the end-informing buzzer 56 rings for 10 seconds, and, after this 10 seconds, a separately provided 120-minutes timer starts to operate. The motor 29 is driven for 10 seconds at a time interval of 5 minutes thereby rotating the drum 12 to cause tumbling movement of the clothes and also driving the fan 27 to supply a cooling blast of air. Thus, the anti-wrinkle step of preventing wrinkling of the clothes is executed for a period of time which is as long as 120 minutes at the maximum. After this 120 minutes, the system is initialized (that is, all the flags are cancelled) to be restored to the original state in which the power switch 40 only is in its closed or on position, so as to prepare for the next drying operation.

When the user opens the door 5 to remove the clothes during the cool-down step or anti-wrinkle step, any further operation ceases, and the system is forcedly restored to its original state.

When the door 5 is opened during the drying operation by heated air for inserting additional articles of fabric or withdrawing specific articles of fabric, both the motor 29 and the heater 22 are de-energized, and a determination is made as to whether or not the "A read flag" is registered, as shown in FIG. 7B. That is, a decision is made as to whether or not the operation period of time has reached the time length of $t_1$. When it is determined that the operation period of time exceeds $t_1$, the "stop flag" is registered, and the system waits for closure of the door 5. After the door 5 is closed, the "stop flag" remains registered until a period of time of 10 minutes elapses or the measured temperature difference attains the first reference value A, as shown in FIG. 7C. The "stop flag" is cancelled as soon as the measured temperature difference exceeds the first reference value A. However, when the measured temperature difference does not attain the first reference value A upon lapse of 10 minutes, the temperature difference measured at the end of the period of 10 minutes is now used to replace the previous first reference value A, and the "stop flag" is cancelled to return to the usual operation course.

On the other hand, when the operation period of time is less than $t_1$, the drying operation may be started after closing the door 5 if the operation is not yet started. However, when the drying operation has already started, the "correction flag" is registered, and the period of time $t_1=15$ minutes at the end of which the first reference value A is read, is extended by 1 minute, so that the operation period of time $t_1$ is now set at 16 minutes, and the operation stop time is counted. Each time a period of time of 1 minute elapses, the time $t_1$ is further extended by 1 minute. When the door 5 is opened once, and the resultant operation stop time exceeds 5 minutes, the system is forcedly restored to the original state. Further, when the door 5 is opened and closed a plurality of times, and the period of time $t_1$ exceeds 19 minutes, the value of $t_1$ is forcedly replaced by 19 minutes.

Such a manner of operation attributable to the opening and closing the door 5 is repeated from A0 in FIG. 7E.

Figure 7F:
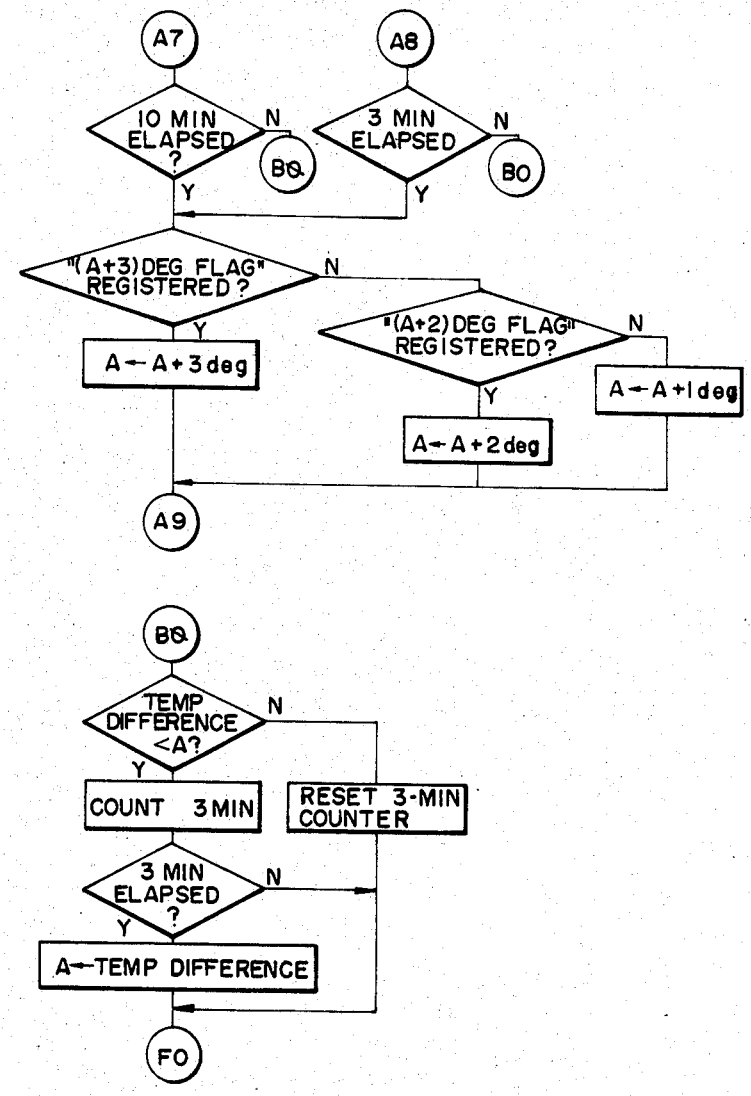

When the temperature difference actually measured in the constant-rate drying period deviates from the first reference value A having been read at the end of the operation period of time $t_1$, whether the deviation is +1 degree, +2 degrees, +3 degrees or $-\alpha$ degrees is detected so as to correspondingly correct the first reference value A. Further, when the detected duration is +4 degrees, it is decided that the falling-rate drying period has already taken place, and the first reference value A is not corrected as shown in FIGS. 7E and 7F. The manner of detection of a positive deviation is such that the deviation is +2 degrees when it is not +1 degree and the deviation is +3 degrees when it is not +2 degrees. For example, once an "(A+3)degrees flag" is registered, a correction counter counts the length of time continuously unless the measured temperature difference becomes equal to or more than (A+4) degrees thereafter. When the operation period of time is less than 30 minutes, the first reference value A is replaced by (A+3) degrees after the counter counts 3 minutes. Then, the "+ correction flag" is cancelled, and the correction counter is cleared. This replacement of the first reference value A is executed each time the corresponding flag is registered, but the previous first reference value A is maintained for 3 or 10 minutes. This holding time is provided so that the end of the drying operation by heated air can be accurately detected while correcting the first reference value A as much as possible in the initial stage of the constant-rate drying period, but not so drastically correcting the first reference value A in the final stage of that period. When the measured temperature difference becomes less than the first reference value A, the temperature difference actually measured after 3 minutes from then is employed as the new first reference value A, under the condition that such a state continues for 3 minutes.

In each of the standard course and the elaborate course, a determination is made as to whether or not the measured temperature difference attains the (A+B) degrees after the "ironing detection flag" is registered (when the measured temperature difference is (A+2) degrees). When the measured temperature difference continues to be equal to the (A+B) degrees for 1 minute after attainment of the level of (A+B), the standard course shifts to the cooling mode, while, in the case of the elaborate course, it continues further for an additional length of time of 0.2T from then, as shown in FIG. 7G. On the other hand, however, the counter counts a length of time corresponding to 50% of the period of time $t_2$ elapsed until the "ironing detecting flag" is registered. That is, the time of $0.5t_2$ is counted, regardless of whether or not the measured temperature difference becomes more than (A+B) after the "ironing detection flag" is registered. Upon lapse of this period of time of $0.5t_2$, the standard course is forcedly shifted to the cooling mode. On the other hand, in the case of the elaborate course, counting of the period of time of 0.2T is immediately started.

The meritorious effects of the aforementioned embodiment of the present invention are as follows:

(I) When the ironing course or the standard course is selected, the selected course can shift to the cooling mode after the measured temperature difference exceeds the value of (A+B) and such a state continues for 2 minutes and 30 seconds or 1 minute. Suppose, for example, the case in which many clothes in the form of a bunch are contained in the drum 12. In such a case, the blast or stream of heated air may sometimes be directly exhausted from the outlet 14, with the result that the measured temperature difference may instantaneously increase to a value larger than the value of (A+B). Therefore, when the selected course shifts to the cooling mode merely because the measured temperature difference exceeds the value of (A+B), underdrying or non-uniform drying of clothes may occur depending on the quantity or situation of the load put in the drum 12. However, according to the embodiment of the present invention in which the selected course shifts to the cooling mode only when the measured temperature difference exceeds the value of (A+B) and such a state continues for a predetermined length of time, clothes can be dried with the least possibility of giving rise to underdrying or non-uniform drying.

(II) The door 5 is opened after the "A read flag" is registered, for the purpose of, for example, observing the extent of dryness, loading additional clothes, or removing clothes. The opening of the door 5 results in a drop of the temperature at the drum outlet 14 and results also in a decrease of the measured temperature difference. That is, a deviation from the stored first reference value A occurs naturally even when the door 5 is then immediately closed. Therefore, the reference value A has been immediately replaced by a smaller value in a prior art dryer of this kind. This means that the new value of (A+B) is smaller than the initial value of (A+B). Consequently, the drying operation has terminated relatively earlier resulting in underdrying of clothes. This underdrying of clothes has also occurred when additional clothes are loaded without changing the first reference value A. On the contrary, in the embodiment of the present invention, the system waits for a period of 10 minutes until the measured temperature difference attains the first reference value A, when the door 5 is opened and then closed again. It is needless to mention that the drying operation by heated air is carried out in this period of 10 minutes. On the other hand, when the measured temperature difference does not attain the first reference value A at the end of the period of 10 minutes, the temperature difference measured at that time and having a value close to the first reference value A replaces the old first reference value A. Therefore, the embodiment of the present invention minimizes the possibility that proceeding with the drying operation does not cause the originally loaded clothes to be underdried or the newly added clothes in the drum 12 to be insufficiently dried at the end of the drying operation.

Figure 8:
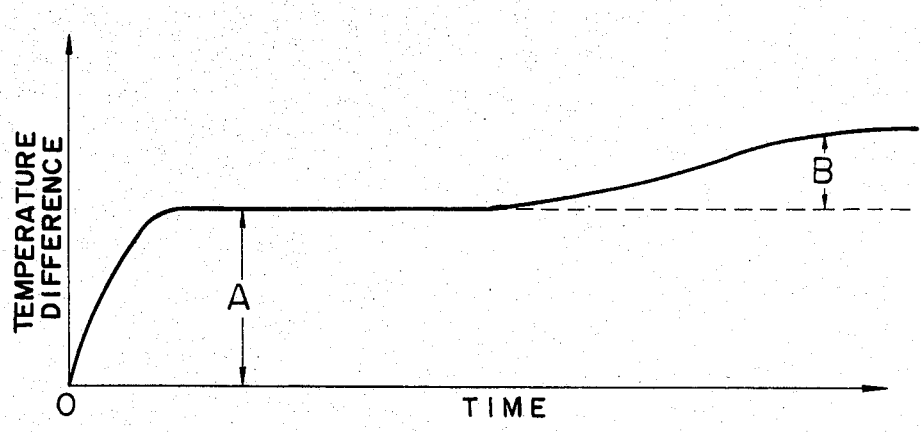
FIG. 8 is a graph showing the relation between the temperature difference and time when the clothes dryer shown in FIG. 1 is loaded with a special load such as jeans.

(III) In the case of a special load such as jeans, the characteristic curve representing the temperature difference relative to time is as shown in FIG. 8. It will be seen that the measured temperature difference increases gradually in the constant-rate drying period. Therefore, attainment of the level of (A+B) is delayed resulting in a delayed end of the drying operation. Further, when the first reference value A is continually changed to meet the actually measured value of the temperature difference to deal with a load such as sheets (as, for example, disclosed in Japanese Patent Early Publication No. 58-173599), attainment of the level of (A+B) is further delayed, and the drying operation would not come to its end as scheduled. According to the embodiment of the present invention, the drying operation is forcedly shifted to the cooling mode when a period of $0.5t_2$ (50% of the operation period of time $t_2$) has elapsed after the "ironing detection flag" is registered when the reference value is set at (A+2) degrees. Therefore, even in the case of such a special load, the drying operation can be reliably ended without causing overdrying of the clothes, and the clothes are dried at the desired rate of dryness. The level of (A+2) degrees can be attained for almost all of loads including such special loads.

(IV) In the case of a large-sized load such as sheets, the sheets tend to take a lump form in the initial stage of the drying operation thereby increasing the measured temperature difference, and such a temperature difference is read to be used as the first reference value A. The sheets become disentangled from each other as the drying operation progresses, and the measured temperature difference decreases to a substantially constant value. Since, therefore, the measured temperature difference is less than the first reference value A, the operation period of time is extended, and the drying operation would not come to its end when the predetermined value B is corrected in the course of the drying operation. Although the reference value A can be made closer to the proper value by selecting the operation period of time $t_1$ to be longer than 15 minutes, it leads to such a defect that the operation period of time is merely extended in the case of an ordinary load. The manner of control according to the embodiment of the present invention is such that, when the measured temperature difference is less than the first reference value A and the above state continues for 3 minutes, the first reference value A is replaced by the value of the temperature difference measured at that time, so as to set the first reference value A at the optimum value. Further, a reduction of the ambient air temperature results in corresponding lowering of the temperature at the drum outlet 14. In such a case too, the first reference value A is suitably corrected to deal with the reduced ambient air temperature.

Figure 9:
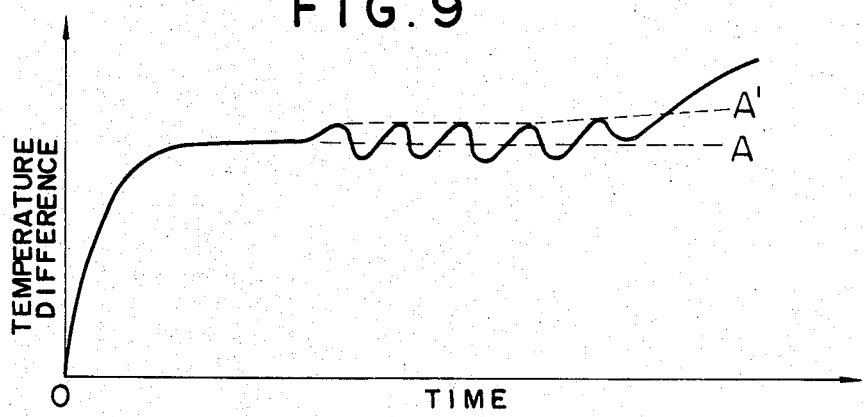
FIG. 9 is a graph showing the relation between the temperature difference and time when the temperature difference fluctuates in a wavy fashion relative to time in the clothes dryer shown in FIG. 1.

(V) In the case of a load such as cotton diapers or sheets, an entangled state and a disentangled state coexist. Consequently, the measured temperature difference fluctuates in a wavy fashion as shown in FIG. 9. When the smallest temperature difference is selected as, or replaced by, the first reference value A as disclosed in Japanese Patent Early Publication No. 58-173599, it is unable to discriminate whether a subsequent increase in the temperature difference is nothing more than a fluctuation or indicates the shifts to the falling-rate drying period. In other words, such an increase may attain the level of (A+B), and the drying operation may be ended without sufficiently drying the clothes. According to the embodiment of the present invention, a determination is made as to whether the measured temperature difference is +1 degree, +2 degrees or +3 degrees relative to the first reference value A, and the first reference value A is replaced by the measured temperature difference which is largest among them. Therefore, even when the measured temperature difference fluctuates in a wavy fashion, the drying operation is not affected by such a fluctuation and would not be ended while leaving the clothes in an insufficiently dried state.

(VI) The more the quantity of the load, the longer is the operation period of time. When the operation period of time exceeds 30 minutes, it can be determined that the quantity of the load is large. Also, in the case of a large quantity of the load, the measured temperature difference increases quite slowly in the falling-rate drying period. Accordingly, when the first reference value A is continually replaced in the constant-state drying period, the measured temperature difference may not attain the level of (A+B), and the drying operation would not be ended as scheduled. The manner of control according to the embodiment of the present invention is such that, the first reference value A is relatively frequently replaced at a time interval of 3 minutes until the operation period of time of 30 minutes elapses, but, thereafter, it is replaced less frequently at a time interval of 10 minutes. Accordingly, even when the measured temperature difference increases slowly in the falling-rate drying period, the level of (A+B) can be accurately attained. Further, when the reference value is replaced by the measured temperature difference at a time interval of a very short time, the operational characteristic varies quite greatly depending on the kind and quantity of the load, resulting in difficulty of control in the next stage. According to the present invention, the first reference value A is replaced at the time interval of 3 minutes so as to minimize the undesirable variation of the operational characteristic and facilitate the control.

Figure 10:
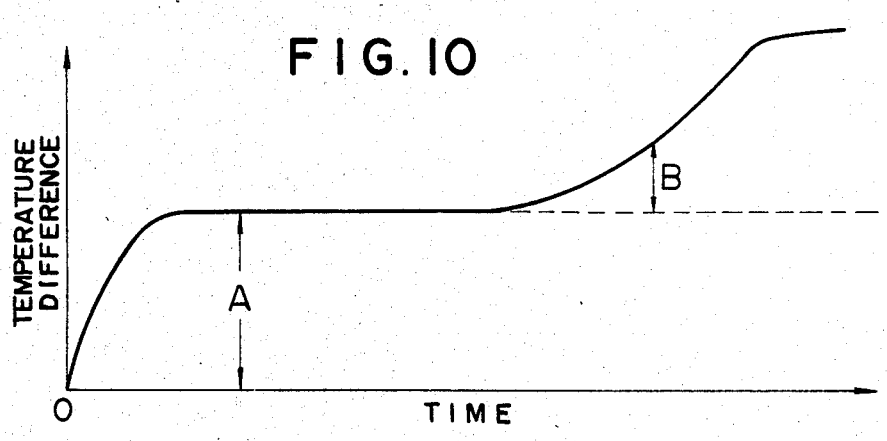
FIG. 10 is a graph showing the relation between the temperature difference and time when the clothes dryer shown in FIG. 1 is loaded with an ordinary load of a relatively large quantity.
Figure 11:
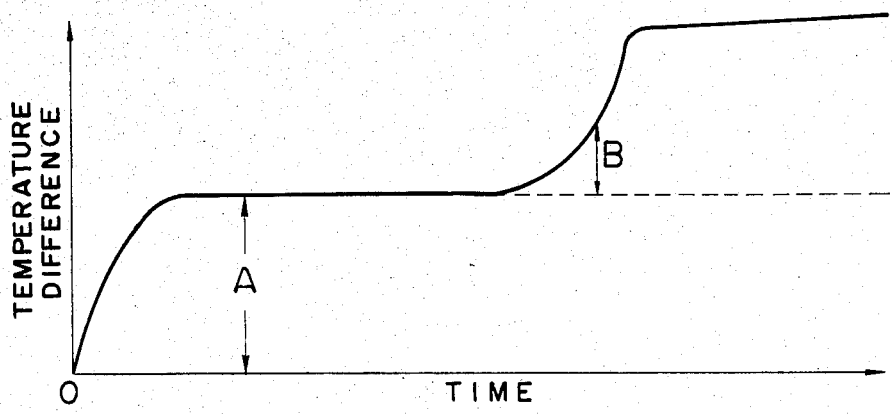
FIG. 11 is a graph showing the relation between the temperature difference and time when the clothes dryer shown in FIG. 1 is loaded with an ordinary load of a relatively small quantity.
Figure 12:
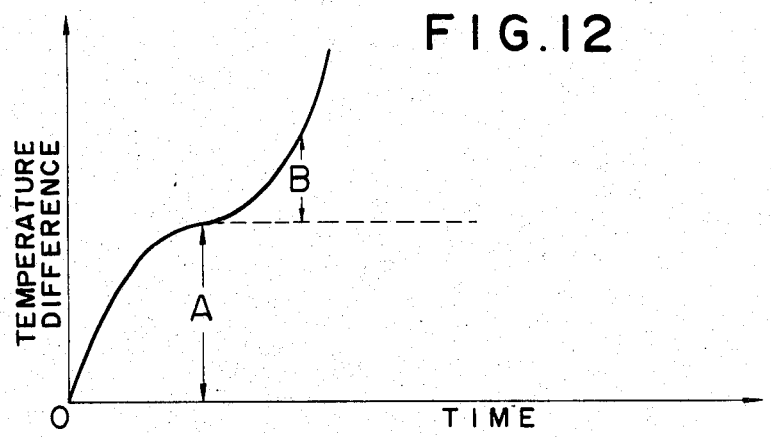
FIG. 12 is a graph showing the relation between the temperature difference and time when the clothes dryer shown in FIG. 1 is loaded with an ordinary load which may be clothes of light texture showing a good rate of dehydration.

(VII) FIG. 10 shows the characteristic curve representing the temperature difference relative to time when the quantity of an ordinary load is relatively large, FIG. 11 shows the above characteristic curve when the quantity of an ordinary load is relatively small, and FIG. 12 shows the above characteristic in the case of clothes of light texture showing a good rate of dehydration, in addition to FIG. 8 which corresponds to the case of a special load such as jeans as described already. It is apparent that the standard end points of drying (the time at which the measured temperature difference attains the level of (A+B)) differ from one another. In regard to the elaborate course, a manner of control has been considered in which the predetermined value B is changed as desired to provide an additional operation period of time so as to achieve the rate of dryness as close to 100% as possible. However, it has been unable to achieve the desired dryness since, as will be seen in these figures, the operation period of time to be added is not the same and changes depending on the load even when the predetermined value B is the same. In other words, it is necessary to change the additional operation period of time depending on the load. Therefore, according to the embodiment of the present invention, the operation period of time T required until the standard course comes to its end (the time point at which a period of 1 minute has elapsed after the measured temperature difference attained the level of (A+B) or the time point at which a period of time of $0.5t_2$ has elapsed from the end of the period of time $t_2$ after the measured temperature difference attained the level of (A+2) degrees) is measured, and 20% of T, that is, 0.2T is selected as the additional operation period of time. Accordingly, the additional operation period of time can be properly determined depending on the load, and each of the individual loads can be dried up to the desired high rate of dryness. Further, since this additional operation period of time 0.2T is selected to be 5 minutes at the minimum and 16 minutes at the maximum, there is no possibility that a useless drying time is added or the additional drying time is too short to achieve the desired high rate of dryness.

It has been confirmed by various tests that the period of time of 0.2T is the most advantageous time for carrying out this purpose.

Figure 13:
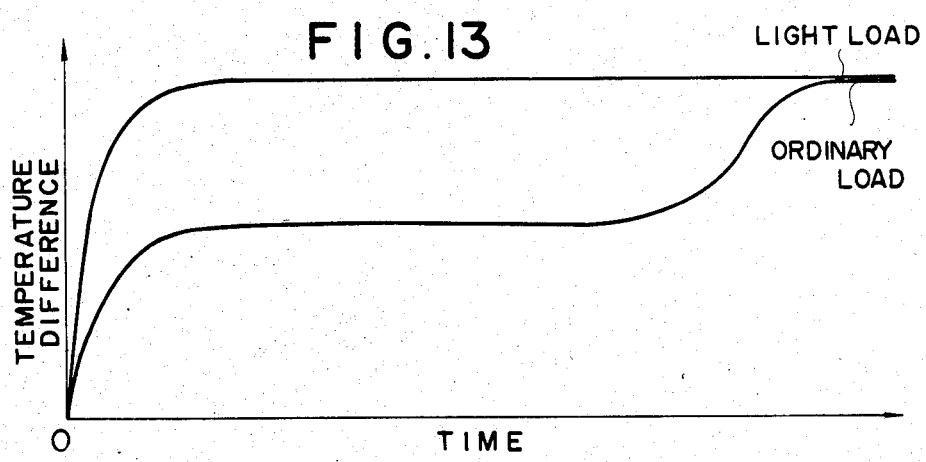
FIG. 13 is a graph showing the relation between the temperature difference and time when the clothes dryer shown in FIG. 1 is loaded with a very light load such as several towels and handkerchiefs.

(VIII) In the case of a load of a very small quantity, for example, several towels and/or handkerchiefs, the characteristic curve representing the temperature difference relative to time is as shown in FIG. 13, and it will be seen in FIG. 13 that there is no falling-rate drying period on the basis of which the end of drying operation is to be measured or determined. Therefore, according to the embodiment of the present invention, the quantity of a load is determined to to be very small when the second reference value which is $A \geqq 25$ degrees (17 degerees when the heater 22 is in its low output level) is detected, and the course other than the elaborate course are shifted to the cooling mode. Therefore, the drying operation for drying a very light load, which has heretofore been manually controlled, can be effectively controlled to minimize the useless operation attributable to the manual control. In the case of elaborate course, the operation period of time of 0.2T is added as described in (VII).

(IX) The temperature at the drum outlet 14 is measured for the purpose of detecting a no-loaded condition of the clothes dryer, and the drying course is shifted to the cooling mode as soon as the measured temperature exceeds a predetermined level. However, its upper limit must be selected to be considerably high so as to deal with a special load such as jeans. Further, in the season such as the winter season in which the temperature of external air is quite low, the temperature at the drum outlet 14 would not rise so sharply, and the function of detecting the no-loaded condition is not sufficiently exhibited. Therefore, according to the embodiment of the present invention, the drying course is forcedly shifted to the cooling mode when the temperature at the drum outlet 14 exceeds 85° C. Also, noting the fact that the measured temperature difference increases under the no-loaded condition when the temperature of external air is low, the drying course is forcedly shifted to the cooling mode when the measured temperature difference exceeds 33 degrees, too. Further, in order that malfunction attributable to momentary measurement of a no-loaded condition may not take place due to the appearance of noise or the like, the drying course is shifted to the cooling mode under the condition that the no-loaded condition is continuously measured for 4 seconds.

(X) When the door 5 is opened during execution of the so-called cool-down step, in which the cooling stream of air is only supplied as a result of the shift to the cooling mode, or during execution of the anti-wrinkle step following the cool-down step in the embodiment of the present invention, the microcomputer 43 determines that the user opened the door 5 for the purpose of removing clothes, and the system is restored to its original state to prepare for the next drying operation.

We claim:

1. A clothes dryer of the dehumidifying type, which comprises:

a rotatable drum for receiving a wash load for drying, the drum defining an interior drying space;

means defining an air outlet, the air outlet being in communication with the interior drying space of the drum and provided for allowing exhaust air from the interior drying space to pass therethrough;

means defining an air inlet, the air inlet being in communication with the interior drying space of the drum and provided for allowing reheated and dehumidified exhaust air to reenter the interior drying space;

a heat exchanger, the heat exchanger being in communication with the air outlet and provided for subjecting the exhaust air to heat exchange with external air entering the clothes dryer and for dehumidifying the exhaust air;

a heater being in communication with the heat exchanger and provided for heating the dehumidified exhuast air;

a fan being in communication with the air inlet and provided for supplying the reheated exhaust air to the drum drying space;

first heat-sensitive means for measuring the temperature of the exhaust air at the air outlet;

second heat-sensitive means for measuring one of the temperature of the exhaust air after the exhaust air has been dehumidified by the heat exchanger but before the exhaust air has been reheated by the heater and the temperature of the external air after the exhaust air has been subjected to heat exchange with the external air, the second heat-sensitive means being adapted to measure the temperature of the exhaust air or the external air at a predetermined time after a heat drying operation of the clothes dryer has started and being adapted to continually measure said temperatures subsequent to said predetermined time;

memory means for storing, as a reference value A, the difference between the temperatures measured by the first and second heat-sensititve means; and control means for terminating the heat drying operation after a preselected time has elapsed from when the difference between the temperatures continually measured by the first and second heat-sensitive means subsequent to the predetermined time at least equals the sum of reference value A and a selected value B, the value B varying in accordance with the time which has elapsed from the start of the heat drying operation.

2. A clothes dryer as claimed in claim 1, wherein the control means is further adapted to periodically compare said reference value A with the difference in temperatures continually measured by said first and second heat-sensitive means subsequent to the predetermined time, said control means making the comparison at a first rate of time during a time interval between the time at which the heat drying operation starts and a preselected time, and at a second rate of time after the preselected time, said reference value A being changed depending on the result of comparison.

3. A clothes dryer as claimed in claim 2, wherein said reference value A is progressively increased when said result of comparison proves that the temperature difference measured subsequent to the predetermined time is larger than said reference value A.

4. A clothes dryer as claimed in claim 2, wherein, when said result of comparison proves that the temperature difference measured subsequent to the predetermined time continues to be smaller than said reference value A for a predetermined period of time, said reference value A is replaced by a smaller temperature difference measured subsequent to the predetermined time.

5. A clothes dryer as claimed in claim 2, wherein, when said reference value A is periodically compared at the first rate of time with the temperature difference measured subsequent to the predetermined time, and the measured temperature difference continues to be smaller than said reference value A for a predetermined period of time, said reference value A is replaced by a smaller temperature difference measured subsequent to the predetermined time.

6. A clothes dryer as claimed in claim 1, wherein the drum includes a door which is adapted to be selectively opened and closed, and wherein the drying operation by heated air is halted temporarily when the door is opened, and wherein upon closing the door, the dryer resumes a drying operation, and when a temperature difference measured subsequent to the door closing continues to be smaller than said reference value A for a predetermined period of time, and reference value A is replaced by a smaller measured temperature difference.

7. A clothes dryer as claimed in claim 1, wherein reference value A is stored in said memory means at said predetermined time, and wherein the drum includes a door which is adapted to be selectively opened and closed, and wherein the drying operation by heated air is halted temporarily when the door is opened, and wherein, when the door is opened before said predetermined time at which said reference value A is stored in said memory means, the timing of storing said reference value A is deferred depending on the length of time during which the door is kept opened.

8. A clothes dryer according to claim 1, wherein the drying operation by heated air terminates when an extended additional period of time corresponding to a predetermined percentage of an operation period of time T has elapsed, said operation period of time T defining the length of time in which a specific period of time has elapsed from the time where the measured temperature difference has attained the sum of said reference value A and the predetermined value B changing depending upon the length of time elapsed from the starting time of the drying operation.

9. A clothes dryer as claimed in claim 8, wherein said additional operation period of time is limited between a predetermined minimum and a predetermined maximum.

* * * * *